United States Patent [19]

Kolesky

[11] Patent Number: 4,800,606

[45] Date of Patent: Jan. 31, 1989

[54] DIGIT NAIL CLEANING DEVICE

[76] Inventor: Johan Kolesky, P.O. Box 1282, Middleburg, Transvaal Province, South Africa

[21] Appl. No.: 72,789

[22] Filed: Jul. 13, 1987

[30] Foreign Application Priority Data

Jul. 24, 1986 [ZA] South Africa ..... 86/5532

[51] Int. Cl.[4] ..... A45D 29/17

[52] U.S. Cl. ..... 15/97 R; 15/21 R; 132/73.6

[58] Field of Search ..... 15/21 A, 21 R, 21 C, 15/70, 75, 76, 97 R, 101, 104.04, 104.92, 104.94, 244 R; 132/73.6, 75.8

[56] References Cited

U.S. PATENT DOCUMENTS

| | | | |
|---|---|---|---|
| 2,424,509 | 7/1947 | Singer | 15/97 R |
| 2,713,693 | 7/1955 | Johnson | 15/97 R |
| 4,255,826 | 3/1981 | Boyd | 15/97 R |
| 4,381,574 | 5/1983 | Benkovsky | 15/97 R |

OTHER PUBLICATIONS

Darling Magazine, Oct. 13, 1982, Dip 'n Twist advertisement, p. 129.

*Primary Examiner*—Edward L. Roberts
*Attorney, Agent, or Firm*—Ladas & Parry

[57] ABSTRACT

A digit nail cleaning device includes five rotatably mounted circumferentially spaced digit cleaning members and drive means for rotating the cleaning members about their axes, in use. The cleaning members and drive means are housed in an open-ended container. The cleaning members each comprise a hollow circular cylindrical casing with a porous cleansing liner located therein. The liners, which are tubular and of sponge rubber, have a central aperture dimensioned to receive, in use, at least that part of a digit containing the nail therein, such that the liner bears against the nail. The casing and the liner are rotated by the drive means relative to the nail to clean it.

13 Claims, 3 Drawing Sheets

DIGIT NAIL CLEANING DEVICE

BACKGROUND OF THE INVENTION

This invention relates to a cleaning device. More particularly it relates to a digit nail cleaning device.

In the context of this specification the work 'digit' is to be interpreted as meaning a finger or a toe.

SUMMARY OF THE INVENTION

According to the invention there is provided a digit nail cleaning device which includes;

at least one displaceable digit nail cleaning member; and drive means for displacing the cleaning member relative to a digit nail while the nail is in contact with the cleaning member, thereby to clean the nail.

The cleaning member may comprise a hollow circular cylindrical casing which is rotatable about its axis by the drive means, and a cleansing element inside the casing.

The cleansing element may comprise a tubular or sleeve-like porous liner which can be impregnated with a liquid cleansing agent, the central passageway of the liner being dimensioned to receive at least part of the digit such that the liner bears against the nail of the digit. The liner may be of resiliently compressible material. The resiliently compressible material may be foamed or cellular polymeric material such as sponge rubber.

The liner may be removably mounted in the casing to facilitate changing and/or cleaning of the liner. A plurality of liners having different sized central passageways for accommodating different sized digits, may be provided.

The device may include retaining means retaining the liner in position in the casing thereby to prevent relative rotation between the liner and the casing. The retaining means may comprise a plurality of circumferentially spaced first retaining formations on the casing which engage complementary second retaining formations on the liner. The first retaining formations may be longitudinally extending protrusions protruding from the inner surface of the casing, with the second retaining formations being complementary longitudinally extending recesses in the outer surface of the liner.

The drive means may include an electric motor having a drive shaft, and a gear set comprising a drive gear mounted to the motor drive shaft, and a driven gear adapted to be driven by the drive gear, with the cleaning member being mounted to the driven gear. The casing of the cleaning member and the driven gear may be of a synthetic plastics material, and may be an integral moulding.

In one embodiment of the invention, the motor may be a DC operable motor, and the device may then include a battery compartment for housing a battery for the motor. Adaptor means to allow the motor to be operated on electricity supplied by the battery or from a mains supply, may also be provided.

In another embodiment of the invention, the motor may be AC operable, so that electricity from a mains supply can be used to energise the motor.

The drive means may include control means for controlling the operation of the motor, said control means including direction switching means for periodically or cyclically reversing the direction of rotation of the motor. Hence, the cleaning member can rotate in one direction and then in the opposite direction for predetermined periods of time. The control means may include a timer for varying the predetermined periods of time.

A removable lid for closing off the open end of the casing when the cleaning device is not in use, may be provided. The lid may be dimensioned such that it forms an air-tight seal with the casing.

The device may include an open ended container in which the cleaning member is housed, and a cover for closing off the container, the lid for the casing being mounted on the cover so that when the cover is closed, the lid automatically closes off the casing.

According to one embodiment of the invention, the gear set may also comprise a central drive gear mounted to the motor drive shaft, with a plurality of cleaning members, circumferentially spaced around the central drive gear such that the driven gears upon which the cleaning members are mounted are all driven simultaneously by the drive gear, being provided.

The invention will now be described, by way of example, with reference to the accompanying diagramatic drawings.

BRIEF DESCRIPTION OF THE DRAWINGS

In the drawings,

In FIGS. 1 to 4 of the drawings, reference numeral 10 refers generally to a digit nail cleaning device, in accordance with one embodiment of the invention. The device 10 includes five rotatably mounted circumferentially spaced digit cleaning members 12 and drive means, generally indicated by reference numeral 14, for rotating the cleaning members 12, about their axes, in use. The cleaning members 12 and drive means 14 are housed in an open-ended container 16.

Figure 1:
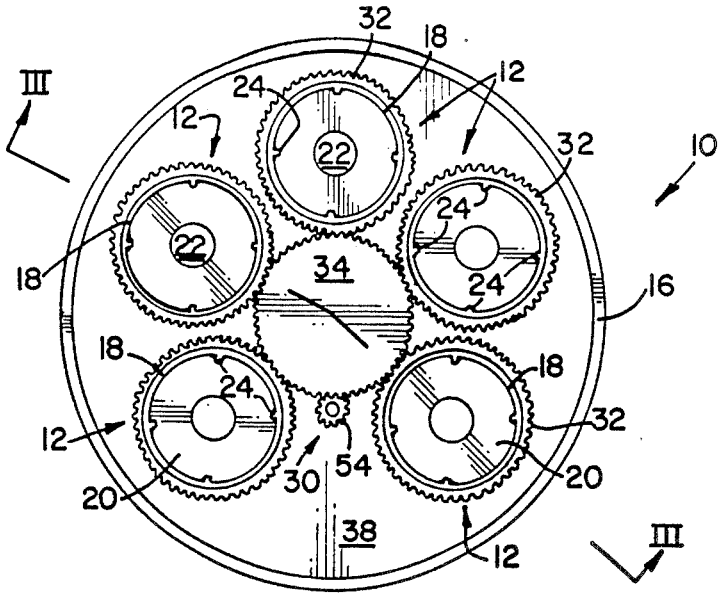
FIG. 1 shows a plan view of a digit nail cleaning device, in accordance with one embodiment of the invention.

The container 16 is divided into two compartments 15, 17 by a partition 38. The cleaning members 12 are located in the compartment 15 and the drive means 14 in the compartment 17, as described in more detail hereunder.

The cleaning members 12 each comprise a hollow circular cylindrical casing 18 with a porous cleansing liners 20 located therein. The liners 20, which are tubular or cylindrical and of sponge rubber, have a central aperture 22 dimensioned to receive, in use, at least the part of a digit (not shown) containing the nail therein, such that the liner bears against the nail. It will be appreciated that sets of liners 20 having different sized apertures 22 may be provided to accommodate different size digits.

To facilitate changing and/or cleaning thereof, the liners 20 are removably located in the casings 18. Relative rotation between the liners 20 and the casings 18 is prevented by four circumferentially spaced longitudinally extending ribs 24 protruding from the inner surfaces of the casings 18 engaging four complementary longitudinally extending recesses 26 in the outer surfaces of the liners 20. This arrangement both allows the liners 20 to be removed easily from the casings 18 and prevents relative rotation therebetween in use.

The drive means 14 includes a DC operable electric motor 28 which drives the cleaning members 12 through a set of gears generally indicated by reference numeral 30. The casing 18 are integrally formed with driven gears 32 of the gear set 30, from synthetic plastics material. The cleaning members 12 are circumferentially spaced around a centrally mounted drive gear 34 such that the associated driven gears 32 are all driven simultaneously by the drive gear 34.

Figure 3:
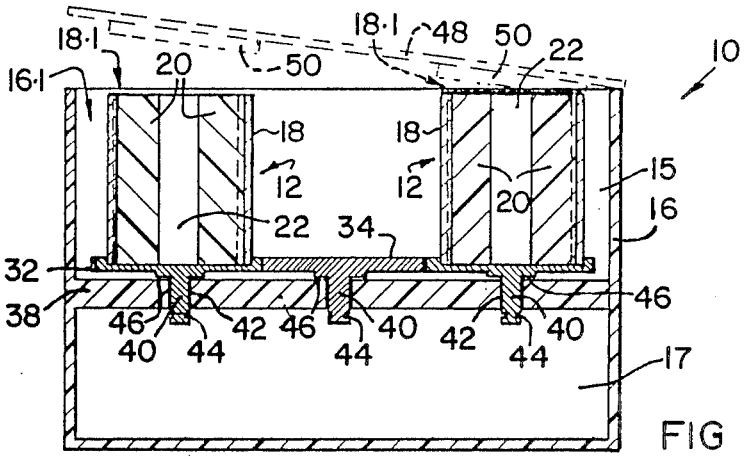
FIG. 3 shows a sectional view taken along III—III in FIG. 1 with details omitted for clarity.

As shown most clearly in FIG. 3, axles 40 of the driven gears 32 as well as the drive gear 34 are mounted on the partition or support platform 38, in the container 16. The axles 40 are located rotatably in complementary passageways 42 in the partition or platform 38. The gears 32 and 34 are retained in position between circlips (not shown) located in an annular groove 44 at the free end of each of the axles 40 which project through the platform 38, and shoulders 46 on the underside of the gears 32 and 34.

Also shown in FIG. 3 in broken line is a cover 48 for closing off the upper open end 16.1 of the container 16. Integral with the cover 48 are five suitably positioned lids 50 which, when the cover is in place on the container, engage and form an air-tight seal with the open ends 18.1 of the casings 18.

When not in use the casings 18 may be sealed by the lids 50 on the cover 48. This helps to keep the liners 20 clean and prevent excess evaporation of any cleaning agent with which the linings have been impregnated whilst the device 10 is not in use.

Figure 2:
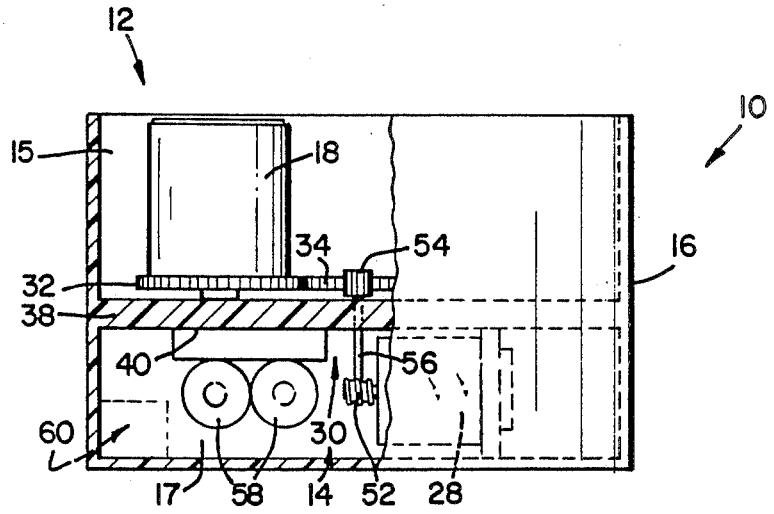
FIG. 2 shows a partly sectioned side view of the device of FIG. 1.

As shown most clearly in FIG. 2 the motor 28 is operatively connected to the drive gear 34 via a worm gear set 52 driving a pinion 54 through a shaft 56 which projects through the platform 38. It will be appreciated that one way of changing the speed at which the cleaning members rotate is by changing the gear ratios.

Electricity supply to the motor 28 is from a battery 58. The battery 58 is located in the compartment 17, and connected through control means, generally indicated by reference numeral 60, to the motor 28.

Figure 5:
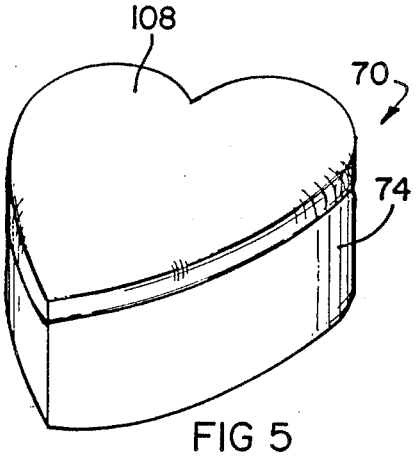
FIG. 5 shows a three dimensional view of a digit nail cleaning device, in accordance with another embodiment of the invention.
Figure 6:
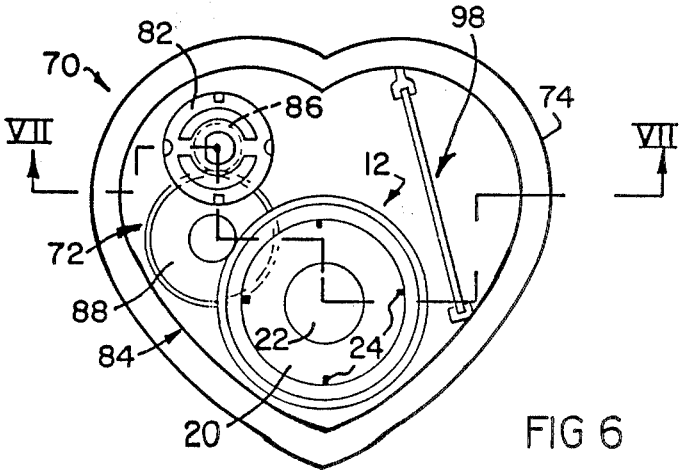
FIG. 6 shows a plan view of the device of FIG. 5 with its cover omitted for clarity.
Figure 7:
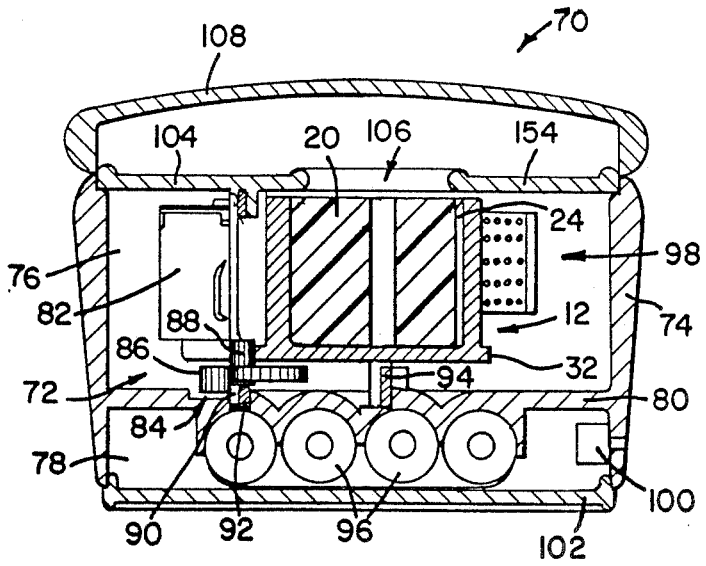
FIG. 7 shows a sectional elevation taken along VII—VII in FIG. 6.

Referring now to FIGS. 5 to 7 inclusive, reference numeral 70 refers generally to another embodiment of a digit nail cleaning device, in accordance with the invention. Items of the device 70 which are the same or similar to those of the device 10 hereinbefore described with reference to FIGS. 1 to 4 are indicated with the same reference numerals. The device 70 includes one rotatably mounted digit cleaning member 12 and drive means, generally indicated by reference numeral 72, for rotating the cleaning member 12 about its axis in use. The cleaning member 12 and drive means 72 are housed in an open ended-container 74.

The container 74 is divided into two compartments 76, 78 by a partition 80. The cleaning member 12 and the drive means 72 are located in the compartment 76, as described in more detail hereunder.

Figure 4:
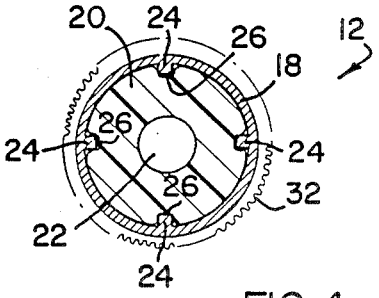
FIG. 4 shows a plan view of one of the cleaning members of FIG. 1.

The cleaning member 12 is similar to that shown in FIG. 4 and will thus not be described in detail again.

The drive means 72 includes a DC operable electric motor 82 which drives the cleaning member 12 through a set of gears generally indicated by reference numeral 84. The set of gears 84 includes a pinion 86 mounted on the output or drive shaft of the motor 82 and driving the gear 32, upon which the cleaning member 12 is mounted, via an idler gear set 88 mounted on an idler gear shaft 90. A can best be seen in FIG. 7 the axles of both the idler gear shaft 90 and the gear 32 are rotatably mounted in bearing 92 and 94 respectively. The bearings are mounted in complementary recesses in the partition 80.

Electricity supply to the motor 82 is from a battery 96. The battery 96 is located in the compartment 78, and connected through control means, generally indicated by reference numeral 98, to the motor 82. Adaptor means generally indicated by reference numeral 100 is provided in the compartment 78 to enable the motor 82 to be operated on electricity supplied from a mains supply. A removable cover 102 is provided in the lower open end of the compartment 78.

A cover 104 is provided in the open upper end of the container 74. The cover 104 has an aperture 106 therethrough which is located directly above the cleaning member 12 and dimensioned to permit the insertion of a digit therethrough into the cleaning member 12. A lid 108 is hingedly mounted to the container 74. The supply of electricity to the motor 82 may be controlled by a switch (not shown) which is activated by the lid 108 such that when the lid 108 is in its closed position shown in FIGS. 5 and 7 the motor 82 is de-energised and when the lid 108 is opened the motor 82 is automatically energised.

Figure 8:
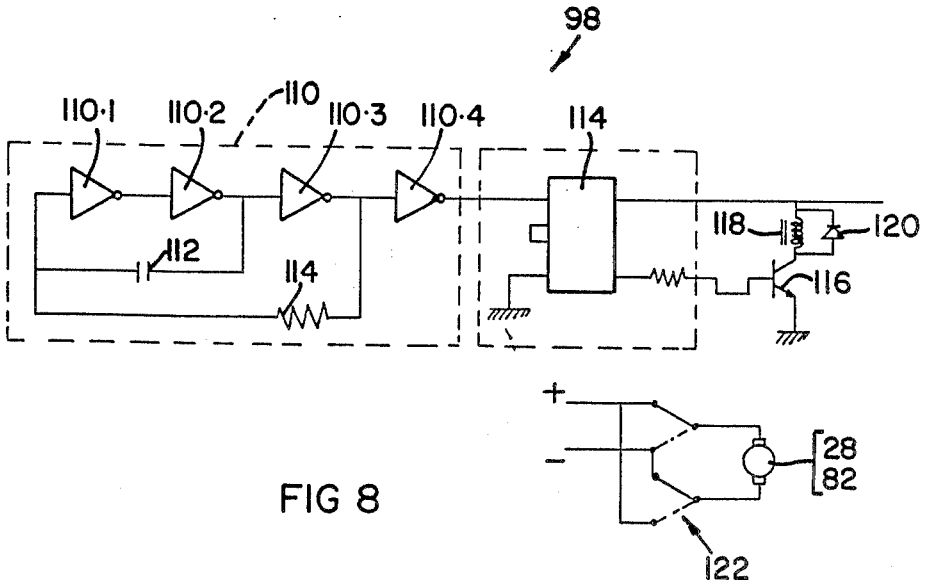
FIG. 8 shows an electrical circuit diagram of control means for controlling the operation of the cleaning devices of FIGS. 1 and 5, the control means forming part of the devices.

Referring now the FIG. 8 of the drawings, the control means 98 includes a hex-inverter, generally indicated by reference numeral 110. The hex-inverter 110 includes four inverters 110.1, 110.2, 110.3 and 110.4 which are of the SN 7404 type. The inverters 110.1 and 110.2 are connected in parallel with a capacitor 112 having a capacitance of 100 $\mu$F. The inverters 110.1, 110.2, and 110.3 are connected in parallel with a resistor 114 having a resistance of 2 k$\Omega$. Thus, the three inverters 110.1, 110.2 and 110.3 are connected as an oscillator having a frequency of 0.5 hz, and the fourth inverter 110.4 is connected as a buffer between the oscillator and the input of a four bit binary counter 114 of the type SN 7493. The four bit binary counter 114 is connected as a frequency-divider to down-convert the frequency to approximately 0.125 hz. The output of the four bit binary counter 114 drives a switching transistor 116 of the type 2N2219, which in turn drives a relay 118 having a free-wheeling diode 120 of the type 1N4004 connected across its terminals. Two-pole-double throw contacts 112 of relay 118 switch the motor 28 or 82 to rotate it successively in one direction and then in the other direction for a period of approximately four seconds.

Thus, in use, the digit(s) is inserted into the cleaning members(s) 12 the liner(s) of which has been impregnated with nail polish remover liquid. The device 70 (or 10) is activated, and this causes the cleaning member(s) to rotate successively first in one direction, then in the other direction so that the liner(s) 20 rub against and consequently cleans the nail(s) of the digit(s). The Applicant believes that the devices 10,70 provide a quick yet effective means for removing nail polish from finger or toe nails.

What I claim is:

1. A digit nail cleaning device which includes:

at least one displaceable digit nail cleaning member comprising a circular cylindrical casing which is rotatable about its axis, and a cleansing element inside the casing;

an electric motor having a drive shaft and a gear set comprising a drive gear mounted on the motor drive shaft, and a driven gear adapted to be driven by the drive gear, wherein the cleaning member is mounted to the driven gear so that the electric motor can displace the cleaning member relative to a digit nail about its axis while the nail is in contact with the cleaning member so as to clean the nail; and control means for controlling the operation of the motor, said control means including direction switching means for cyclically reversing the direction of rotation of the motor.

2. A device as claimed in claim 1, in which the casing of the cleaning member and the driven gear are of a synthetic plastics material, and are an integral moulding.

3. A device as claimed in claim 1, wherein the gear set also comprises a central drive gear mounted to the motor drive shaft, and wherein a plurality of cleaning members, circumferentially spaced around the central drive gear such that the driven gears upon which the cleaning members are mounted are all driven simultaneously by the drive gear, and provided.

4. A device as claimed in claim 1, wherein the cleansing element comprises a tubular porous liner which can be impregnated with a liquid cleansing agent, the central passageway of the liner being dimensioned to receive at least part of a digit such that the liner bears against the nail of the digit, wherein a plurality of circumferentially spaced longitudinally extending protrusions protrude radially inwardly from the inner surface of the casing, and wherein at least one complementary longitudinally extending recess if provided in the outer surface of the liner so as to prevent the relative rotation between the liner and the casing.

5. A digit nail cleaning device which includes:

a plurality of displaceable digit nail cleaning members, each cleaning member comprising a circular cylindrical casing which is rotatable about its axis, and a cleansing element inside the casing;

an electric motor having a drive shaft and a gear set comprising a central drive gear mounted on the motor drive shaft and a plurality of driven gears circumferentially spaced around the drive gear such that they are all driven simultaneously by the drive gear, the cleansing members being mounted on the driven gears so that the electric motor can displace the cleaning member relative to a digit nail about its axis while the nail is in contact with the cleaning member so as to clean the nail.

6. A device as claimed in claim 5 which includes a control means for controlling the operation of the motor, said control means including direction switching means for cyclically reversing the direction of rotation of the motor.

7. A device as claimed in claim 5, wherein each cleansing element comprises a tubular porous liner which can be impregnated with a liquid cleansing agent, the central passageway of the liner being dimensioned to receive at least part of a digit such that the liner bears against the nail of the digit, wherein a plurality of circumferentially spaced longitudinally extending protrusions protrude radially inwardly from the inner surface of the casing, and wherein at least one complementary longitudinally extending recess is provided in the outer surface of the liner so as to prevent the relative rotation between the liner and the casing.

8. A device as claimed in claim 5, wherein the casing of the cleaning member and the driven gears are of a synthetic plastics material, and are an integral molding.

9. A digit nail cleaning device which includes:

at least one displaceable digit nail cleaning member;

an electric motor for rotating the cleaning member relative to a digit nail, when the nail is in contact with the cleaning member, so as to clean the nail; and a control means for controlling the operation of the motor, said control means including direction switching means for cyclically reversing the direction of rotation of the motor.

10. A device as claimed in claim 9, which includes a gear set comprising a drive gear mounted to the motor drive shaft, and a driven gear adapted to be driven by the drive gear, wherein the cleaning member is mounted to the driven gear.

11. A device as claimed in claim 10, wherein the gear set also comprises a central drive gear mounted to the motor drive shaft, and wherein a plurality of cleaning members, circumferentially spaced around the central drive gear such that the driven gear upon which the cleaning members are mounted are all driven simultaneously by the drive gear, are provided.

12. A device as claimed in claim 9, wherein the cleaning member comprises a circular cylindrical casing which is rotatable about its axis by the motor and a cleansing element which comprises a tubular porous liner which can be impregnated with a liquid cleansing agent, the central passageway of the liner being dimensioned to receive at least part of a digit such that the liner bears against the nail of the digit, wherein a plurality of circumferentially spaced longitudinally extending protrusions protrude radially inwardly from the inner surface of the casing, and wherein at least one complementary longitudinally extending recess is provided in the outer surface of the liner, so as to prevent the relative rotation between the liner and the casing.

13. A device as claimed in claim 12, wherein the casing of the cleaning member and the driven gears are of a synthetic plastics material, and are an integral molding.

* * * * *